US011089827B2

(12) United States Patent
Tumpson

(10) Patent No.: US 11,089,827 B2
(45) Date of Patent: Aug. 17, 2021

(54) CLOTHING WITH ALIGNMENT LINES AND INDICIA FOR BIOFEEDBACK

(71) Applicant: One Whirl LLC, Pittsburgh, PA (US)

(72) Inventor: Christine McMahon Tumpson, Pittsburgh, PA (US)

(73) Assignee: One Whirl LLC, Pittsburgh, PA (US)

( * ) Notice: Subject to any disclaimer, the term of this patent is extended or adjusted under 35 U.S.C. 154(b) by 0 days.

(21) Appl. No.: 15/841,370

(22) Filed: Dec. 14, 2017

(65) Prior Publication Data

US 2018/0360146 A1 Dec. 20, 2018

Related U.S. Application Data

(60) Provisional application No. 62/433,958, filed on Dec. 14, 2016.

(51) Int. Cl.
*A41D 27/08* (2006.01)
*A41D 1/08* (2018.01)

(52) U.S. Cl.
CPC ..... *A41D 27/08* (2013.01); *A41D 1/08* (2013.01); *A41D 2600/10* (2013.01)

(58) Field of Classification Search
CPC ..... A41D 1/08; A41D 27/08; A41D 2600/10
USPC ..... 2/227
See application file for complete search history.

(56) References Cited

U.S. PATENT DOCUMENTS 5,201,074 A * 4/1993 Dicker ..... A41D 13/0015 2/227
5,282,277 A * 2/1994 Onozawa ..... A41D 13/00 2/69
5,799,328 A * 9/1998 Harlem ..... A41D 13/1236 2/114
5,978,966 A * 11/1999 Dicker ..... A41D 13/0015 2/115
7,117,537 B2 * 10/2006 Mazzarolo ..... A41D 1/088 2/69
D536,157 S * 2/2007 Kimmel ..... D2/742
7,500,274 B1 * 3/2009 Kallen ..... A41D 1/086 2/227
D613,928 S 4/2010 Iamartino et al.
(Continued)

OTHER PUBLICATIONS

Jala Clothing: Chakra Racer Burnout Tank, Dec. 29, 2015, 1 page, http://www.jalaclothing.com/products/chakra-racerback-burnout-tank.

*Primary Examiner* — Anne M Kozak
(74) *Attorney, Agent, or Firm* — The Webb Law Firm

(57) ABSTRACT

An article of clothing and a method of use thereof by a practitioner of a body position-dependent exercise or discipline. The clothing includes at least one alignment line extending substantially an entire length of a limb of the practitioner. The at least one alignment line is configured to be referenced by the practitioner to confirm proper alignment of the limb according to at least one of the following metrics: direction; rotation; or pitch. The clothing also includes at least one visual indicium positioned on a limb of the practitioner. The at least one visual indicium is configured to be referenced, grasped, or touched by the practitioner using another body part of the practitioner during performance of the exercise or discipline. The method includes wearing the clothing and executing a series of poses or body positions corresponding to the at least one alignment line and the at least one visual indicium.

4 Claims, 2 Drawing Sheets

(56) References Cited

U.S. PATENT DOCUMENTS

| | | | | |
|---|---|---|---|---|
| 8,381,314 | B2 * | 2/2013 | Takamoto | A41D 7/00 2/243.1 |
| 9,144,252 | B1 * | 9/2015 | Kostrzewski | A41D 13/0015 |
| D741,574 | S | 10/2015 | Michaeloff | |
| 9,456,641 | B1 * | 10/2016 | Mignone | A41D 13/0015 |
| 9,642,401 | B2 * | 5/2017 | Yamada | A41D 13/0015 |
| 2005/0086721 | A1 * | 4/2005 | Lambertz | A41D 13/002 2/69 |
| 2006/0169004 | A1 * | 8/2006 | Belluye | A41D 1/084 66/177 |
| 2008/0120757 | A1 * | 5/2008 | Nakazawa | A41D 13/0015 2/22 |
| 2008/0256691 | A1 | 10/2008 | White et al. | |
| 2009/0025115 | A1 * | 1/2009 | Duffy | A41D 1/04 2/69 |
| 2010/0077527 | A1 * | 4/2010 | Lee | A41D 13/0015 2/69 |
| 2010/0186148 | A1 * | 7/2010 | Crockett | A41D 1/08 2/227 |
| 2015/0279232 | A1 | 10/2015 | Pearce Hayden et al. | |
| 2018/0132544 | A1 * | 5/2018 | Albanese | A41D 13/0015 |
| 2019/0029345 | A1 * | 1/2019 | Marchetto | A41D 1/086 |

* cited by examiner

CLOTHING WITH ALIGNMENT LINES AND INDICIA FOR BIOFEEDBACK

CROSS-REFERENCE TO RELATED APPLICATIONS

This application claims the benefit of U.S. Provisional Patent Application No. 62/433,958, filed on Dec. 14, 2016, the disclosure of which is hereby incorporated by reference in its entirety.

BACKGROUND OF THE INVENTION

Field of the Invention

This invention relates to apparel, and in particular, to clothing having alignment lines and indicia for biofeedback, and a method of use thereof.

Description of Related Art

There are a number of methods of bodyweight resistance exercise as well as physical, mental, and spiritual disciplines that employ specific body posturing and positioning. In modern culture, popular practices include yoga, Pilates, Qi Gong, Tai Chi, and/or the like. A common emphasis in many of these practices is making sure to execute correct body positioning and maintain proper body alignment while exercising, breathing, meditating, and/or practicing the art. Certain disciplines, such as Iyengar Yoga or Anusara Yoga, have systematized and categorized poses that depend on properly executing hand, foot, arm, leg, torso, and head positioning, among others. A number of devices have been created in an attempt to encourage correct practice, such as body straps, specially designed yoga mats, foam blocks, belts, blankets, and/or the like. However, these devices all share the principal drawback of requiring the user to carry and manipulate external objects before, during, and/or after a given session. Furthermore, these devices may be principally useful for poses and positions where external resistance or props are required, but they do not necessarily guide a user through poses that consist of unaided, body-resistance only exercise.

Therefore, there is a need in the art for a device that guides a practitioner through one or more exercises and/or discipline poses, wherein the practitioner does not have to carry or manipulate the device separately from their postures.

SUMMARY OF THE INVENTION

Clothing and a method of use thereof by a practitioner of a body position-dependent exercise or discipline are provided. Preferably, the clothing includes at least one alignment line configured to be referenced by the practitioner to confirm proper alignment of a limb. Preferably, the clothing includes at least one visual indicium configured to be a reference for contact during performance of the exercise or discipline.

According to one preferred and non-limiting embodiment or aspect, the clothing enables a practitioner of a body position-dependent exercise or discipline to verify proper body positioning. The clothing includes at least one alignment line extending substantially an entire length of a limb of the practitioner. The at least one alignment line is configured to be referenced by the practitioner to confirm proper alignment of the limb according to at least one of the following metrics: direction; rotation; or pitch. The clothing also includes at least one visual indicium positioned on a limb of the practitioner. The at least one visual indicium is configured to be referenced, grasped, or touched by the practitioner using another body part of the practitioner during performance of the exercise or discipline.

In further preferred and non-limiting embodiments or aspects, the at least one alignment line may include a first alignment line positioned on an anterior surface of the limb configured for positional reference as viewed from an anterior perspective of the limb. The at least one alignment line may also include a second alignment line positioned on an interior surface of the limb configured for positional reference as viewed from an interior perspective of the limb. The at least one alignment line may further include a third alignment line positioned on a posterior surface of the limb configured for positional reference as viewed from a posterior perspective of the limb. The at least one visual indicium may include a first visual indicium positioned above and proximal to a middle joint of the limb. The at least one visual indicium may also include a second visual indicium positioned at the distal end of the limb. The at least one visual indicium may further include a third visual indicium positioned proximal to a torso-connecting joint of the limb. Preferably, the clothing is embodied as yoga pants.

In further preferred and non-limiting embodiments or aspects, the first alignment line may be an anterior alignment line positioned along the front of a first leg of the practitioner. The second alignment line may be an interior alignment line positioned along the inseam of the first leg or a second leg of the practitioner. The third alignment line may be a posterior alignment line positioned along an exterior side and/or back of the first leg of the practitioner. The first visual indicium may be an above-knee indicium proximal to a knee of the second leg of the practitioner. The second visual indicium may be an ankle indicium proximal to the ankle of the second leg of the practitioner. The third visual indicium may be a mid-thigh indicium positioned between a hip and a knee of the first leg of the practitioner. A color of the alignment lines and a color of the visual indicium may be a same first color configured to trigger a predetermined psychophysiological reaction in the practitioner. A visual indicium of the at least one visual indicium may include a chakra symbol for reference by a practitioner that is configured to represent a state of mind corresponding to a target state of mind to be acquired by executing a series of poses represented by positioning of the at least one visual indicium. According to one preferred and non-limiting embodiment or aspect, provided is a method of using the clothing, as described above, comprising wearing the clothing and executing a series of poses or body positions corresponding to the at least one alignment line and the at least one visual indicium.

Other preferred and non-limiting embodiments or aspects of the present invention will be set forth in the following numbered clauses.

Clause 1: An article of clothing for use by a practitioner of a body position-dependent exercise or discipline to verify proper body positioning, the clothing comprising: at least one alignment line extending substantially an entire length of a limb of the practitioner, the at least one alignment line configured to be referenced by the practitioner to confirm proper alignment of the limb according to at least one of the following metrics: direction, rotation, and pitch; and, at least one visual indicium positioned on a limb of the practitioner, the at least one visual indicium configured to be referenced, grasped, or touched by the practitioner using another body part of the practitioner during performance of the exercise or discipline.

Clause 2: The article of clothing of clause 1, wherein the at least one alignment line comprises: a first alignment line positioned on an anterior surface of the limb configured for positional reference as viewed from an anterior perspective of the limb; a second alignment line positioned on an interior surface of the limb configured for positional reference as viewed from an interior perspective of the limb; and a third alignment line positioned on a posterior surface of the limb configured for positional reference as viewed from a posterior perspective of the limb.

Clause 3: The article of clothing of clauses 1 or 2, wherein the at least one visual indicium comprises: a first visual indicium positioned above and proximal to a middle joint of the limb; a second visual indicium positioned at the distal end of the limb; and a third visual indicium positioned proximal to a torso-connecting joint of the limb.

Clause 4: The article of clothing of any of clauses 1-3, wherein the article of clothing comprises yoga pants.

Clause 5: The article of clothing of any of clauses 1-4, wherein the first alignment line is an anterior alignment line positioned along the front of a first leg of the practitioner, the second alignment line is an interior alignment line positioned along the inseam of the first leg or a second leg of the practitioner, and the third alignment line is a posterior alignment line positioned along an exterior side and/or back of the first leg of the practitioner.

Clause 6: The article of clothing of any of clauses 1-5, wherein the first visual indicium is an above-knee indicium proximal to a knee of the second leg of the practitioner, the second visual indicium is an ankle indicium proximal to the ankle of the second leg of the practitioner, and the third visual indicium is a mid-thigh indicium positioned between a hip and a knee of the first leg of the practitioner.

Clause 7: The article of clothing of any of clauses 1-6, wherein a color of the alignment lines and a color of the visual indicium are a same first color configured to trigger a predetermined psychophysiological reaction in the practitioner.

Clause 8: The article of clothing of any of clauses 1-7, wherein a visual indicium of the at least one visual indicium comprises a chakra symbol for reference by a practitioner that is configured to represent a state of mind corresponding to a target state of mind to be acquired by executing a series of poses represented by positioning of the at least one visual indicium.

Clause 9: A method of using the article of clothing as described in any of clauses 1-8 comprising wearing the clothing and executing a series of poses or body positions corresponding to the at least one alignment line and the at least one visual indicium.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

BRIEF DESCRIPTION OF THE DRAWINGS

FIG. 3 is a depiction of a non-limiting embodiment or aspect and method of using clothing with alignment lines and indicia for biofeedback, according to the principles of the present invention; and FIG. 4 is a depiction of a non-limiting embodiment or aspect and method of using clothing with alignment lines and indicia for biofeedback, according to the principles of the present invention.

DETAILED DESCRIPTION OF THE INVENTION

Figures 1A, 1B, 1C, 1D:
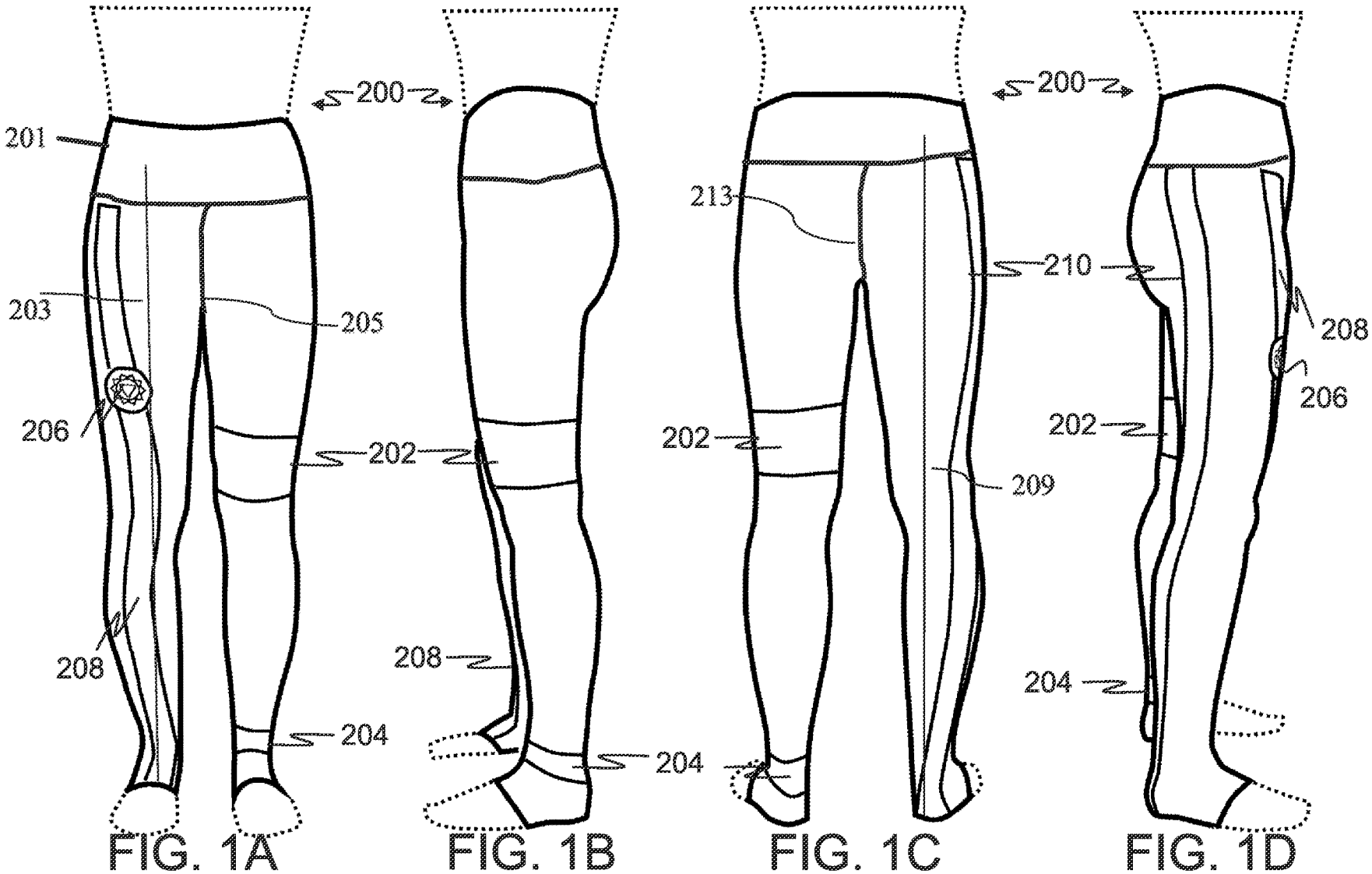
FIGS. 1A-1D are a series of alternate views of a non-limiting embodiment or aspect of clothing with alignment lines and indicia for biofeedback, according to the principles of the present invention.

For purposes of the description hereinafter, the terms "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific designs and processes illustrated in the attached drawings, and described in the following specification, are simply exemplary embodiments of the invention. Hence, specific dimensions and other physical characteristics related to the embodiments disclosed herein are not to be considered as limiting.

With specific reference to FIG. 1, comprised of FIGS. 1A-1D, and in one preferred and non-limiting embodiment or aspect, provided is a series of alternate views of clothing with alignment lines and indicia for biofeedback, according to the principles of the present invention. Although, the wearer/Practitioner is depicted and described as female, it will be appreciated that the invention is applicable to both genders. FIG. 1A depicts a front view, FIG. 1B depicts a left-side view, FIG. 1C depicts a back view, and FIG. 1D depicts a right-side view. Specifically, depicted are example yoga pants 200 with a number of alignment lines and indicia for assuming one or more yoga poses. It will be appreciated that the indicia and lines may be adapted and configured to various poses, within the scope of the invention, and that the embodiments depicted are specifically adapted to a subset of possible yoga positions. Provided is an above-knee indicium 202, which may be used as a guided contact point for the user's hand, foot, or other body part. As shown, the above-knee indicium 202 begins at approximately the lower tendon of the rectus femoris muscle and wraps around the user's leg, remaining above the back of the user's knee. In this way, when viewed from the front, side, or rear, which may occur in various poses, a user can observe the position of the above-knee indicium 202. Also provided is an ankle indicium 204, which also may be used as a guided contact point for the user's hand, foot, or other body part. As shown, the ankle indicium 204 is positioned approximately at or just above the user's lateral and medial malleolus, wrapping around the user's leg and remaining above the user's heel. In this way, when viewed from the front, side, or rear, which may occur in various poses, a user can observe the position of the ankle indicium 204. Also provided is a mid-thigh indicium 206, which may be used as a guided contact point for the user's hand, foot, or other body part. As shown, the mid-thigh indicium 206 is positioned substantially centrally along an anterior alignment line 208 and is located approximately equidistant between the user's hip and knee. The indicia provide visual positioning biofeedback as the user moves from one pose to another and learns to control their body movement and function. Additionally, the mid-thigh indicium 206, as depicted, is a Manipura chakra symbol, which is regarded in Hindu tradition as the "solar plexus chakra" and is associated emotionally with self-determination, mental sharpness, and a sense of self. This symbolism may encourage practitioners to focus and meditate on these qualities while performing the various predetermined poses, which may be selected to target achieving the mental state or qualities symbolized by the chakra symbol. In this way, both mental and physical health are promoted via the visual indicia. It will be appreciated that other chakra symbols, or designs in general, may be employed as a mid-thigh indicium 206, or for any of the other indicia. It will also be appreciated that the indicia may be differently located for alternate poses in order to provide visual feedback of proper positioning.

Figure 2:
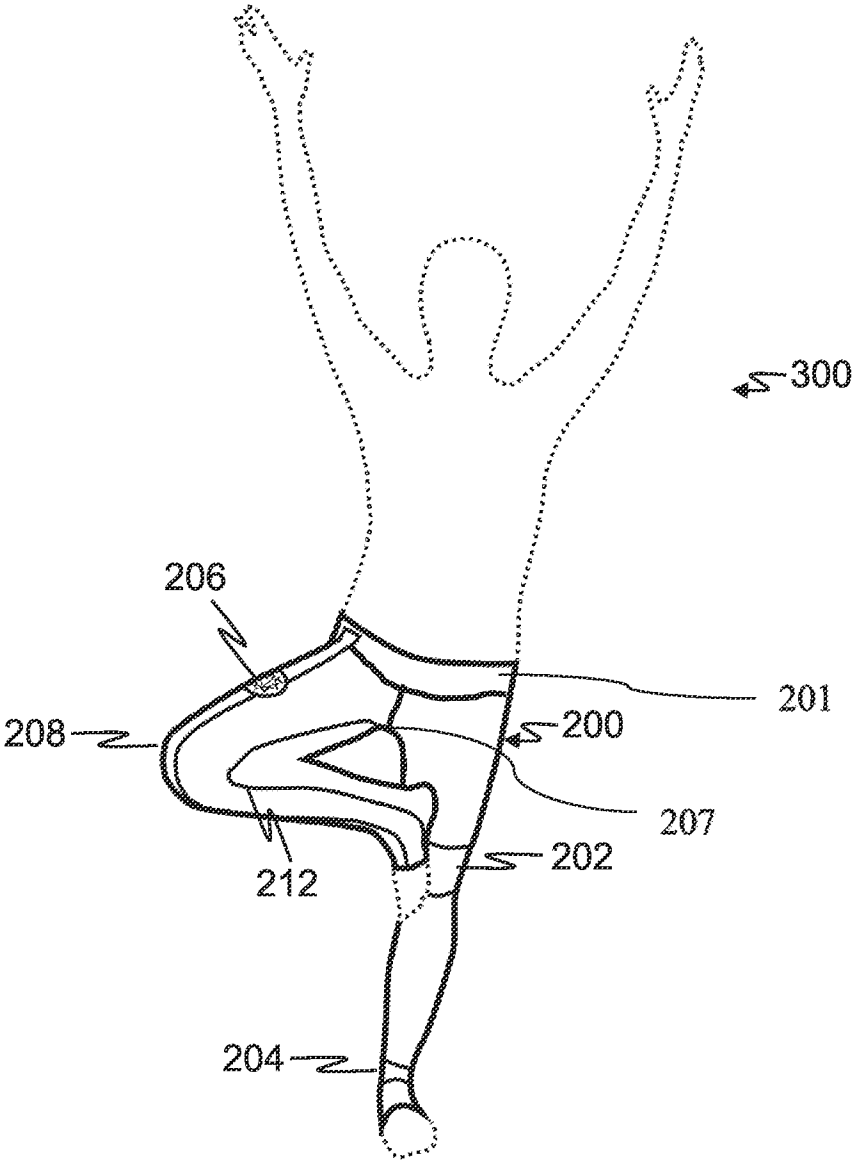
FIG. 2 is a depiction of a non-limiting embodiment or aspect and method of using clothing with alignment lines and indicia for biofeedback, according to the principles of the present invention.

With further reference to FIG. 1, and in a further preferred and non-limiting embodiment or aspect, provided is an anterior first alignment line 208, which extends approximately from the user's hip, along the front of the user's leg, and across the top of the user's foot. The anterior first alignment line 208 may be used to assure that the hip, upper leg, knee, lower leg, and foot of the user are in proper alignment. Proper alignment may be determined by one or more of the following metrics: direction, i.e., side-to-side alignment; pitch, i.e., up-and-down alignment; and rotation, i.e., turning the leg clockwise or counterclockwise about an axis parallel to the limb. The anterior first alignment line 208 may be mirrored on the other leg for opposite positioning, or a single anterior alignment line 208 may be used and referenced for the opposite leg. Additional alignment lines may be employed, such as a posterior third alignment line 210, which likewise can be referenced to assure proper alignment of the practitioner's hip, leg, and foot. As depicted, the posterior third alignment line 210 extends from the side rear of the user's hip down the back and side of the user's leg and to the user's heel. Furthermore, the pants 200 have a waistband 201, and an anterior centered vertical axis 203. Pants 200 also have a front crotch seam 205, and a rear crotch seam 213, with a crotch point 207. On a posterior surface of the first leg of the pants 200, as shown in FIG. 1C, the pants 200 also have a posterior centered vertical axis 209. Referring to FIG. 1A, a first alignment line 208 is positioned vertically lengthwise on an anterior surface of the first pant leg. The first alignment line 208 ends at waistband 201 at a first point that is spaced from the anterior centered vertical axis 203 on an opposite side of the axis from the front crotch seam 205. The first alignment line 208 continues in a curvilinear path along the anterior surface to be aligned centrally with the anterior centered vertical axis 203 at a lower opening of the first pant leg. Referring to FIG. 2, a second alignment line 212 is positioned vertically lengthwise along an inseam surface of the first pant leg. The second alignment line has an end at crotch point 207 and continues along the first pant leg to terminate at the lower opening of the first pant leg. Referring to FIGS. 1C, and 1D, a third alignment line 210 is positioned vertically lengthwise on a posterior surface of the first pant leg. The third alignment line 210 ends at waistband 201 at a second point that is spaced from a posterior centered vertical axis 209 on a side of the axis that is opposite rear crotch seam 213. The third alignment line 210 continues in a curvilinear path along the posterior surface to be aligned centrally with the posterior centered vertical axis 209 at the lower opening of Alignment lines provide biofeedback to control body movement and function and may be referenced by the practitioner herself, or by third parties to confirm correct body alignment. For example, instructors may reference the alignment lines to correct the user's positioning. Further, fellow practitioners may reference the user's alignment lines to mimic or adjust their own body positioning. It will be appreciated that many other configurations or arrangements are possible.

With specific reference to FIG. 2, and in one preferred and non-limiting embodiment or aspect, provided is example clothing with alignment lines and indicia for biofeedback, including a method of use thereof. As shown, depicted are yoga pants 200 including at least an anterior alignment line 208, a mid-thigh indicium 206, an above-knee indicium 202, an interior alignment line 212, and an ankle indicium 204. In the preferred example, the practitioner is making use of the alignment lines and indicia to assume the Tree Pose 300, also called the Vrksasana. To assume the Tree Pose 300, the practitioner follows the following steps while referencing the alignment lines and indicia. The practitioner shifts her weight onto her left foot, centering her balance on the inner part of the foot. The practitioner lifts her right foot up and places it against her left inner thigh. Using the above-knee indicium 202 as a guide, the practitioner presses her right heel toward her inner left groin and places her right toes or foot on the above-knee indicium 202. The practitioner may use the anterior alignment line 208, facing up, to verify that her right leg is not pronating or supinating. She may also reference the interior alignment line 212, facing outward, to verify that her hips are open and in a neutral position. The practitioner then lengthens her tailbone toward the floor and focuses her attention forward at a fixed point. She may also raise her arms up and above her head. After approximately thirty seconds to a minute, the practitioner reverses her movements and may repeat the exercise on opposite legs. The alignment lines and indicia may be symmetrical for equal reference on both sides. Alternatively, as shown, the alignment lines and indicia are provided for reference on one side, and the body positioning may be copied over to the opposing side when the exercise is reversed. It will be appreciated that other configurations and arrangements are possible.

With specific reference to FIG. 3, and in one preferred and non-limiting embodiment or aspect, provided is example clothing with alignment lines and indicia for biofeedback, including a method of use thereof. As shown, depicted are yoga pants 200 including at least a posterior alignment line 210, an above-knee indicium 202, an interior alignment line 212, and an ankle indicium 204. In the preferred example, the practitioner is making use of the alignment lines and indicia to assume the Warrior I Pose 400, also called the Virabhadrasana I. To assume the Warrior I Pose 400, the practitioner follows the following steps while referencing the alignment lines and indicia. The practitioner separates her feet forward and behind by approximately three to four feet, as shown. She then raises her arms to be perpendicular to the floor and parallel to each other. She positions her feet at angles off of her centerline using the alignment lines as a reference. She may reference the interior alignment line 212, facing forward and downward, to assure that the leg is sufficiently open and behind. She may also reference an anterior alignment line 208 (not shown) to assure that her lead leg is straight, both directionally and rotationally. The front leg is bent, but the front knee does not overextend over the front foot. These steps may be taken as part of a sequence of poses, also called a vinyasa in yoga practice, and may progress from a High Lunge Pose. After approximately thirty seconds to a minute, the practitioner reverses her movements and may repeat the exercise on opposite legs. The alignment lines and indicia may be symmetrical for equal reference on both sides. Alternatively, as shown, the alignment lines and indicia are provided for reference on one side, and the body positioning may be copied over to the opposing side when the exercise is reversed. It will be appreciated that other configurations and arrangements are possible.

With specific reference to FIG. 4, and in one preferred and non-limiting embodiment or aspect, provided is example clothing with alignment lines and indicia for biofeedback, including a method of use thereof. As shown, depicted are yoga pants 200 including at least a posterior alignment line 210, an above-knee indicium 202, an interior alignment line 212, and an ankle indicium 204. In the preferred example, the practitioner is making use of the alignment lines and indicia to assume the Reverse Warrior Pose 500, also called the Viparita Virabhadrasana. To assume the Reverse Warrior Pose 500, the practitioner follows the following steps while referencing the alignment lines and indicia. The practitioner separates her feet forward and behind by approximately three to four feet, as shown. She then raises her arms to be perpendicular to the floor and parallel to each other. She positions her feet at angles off of her centerline using the alignment lines as a reference. She may reference the interior alignment line 212, facing forward and downward, to assure that the leg is sufficiently open and behind. She may also reference an anterior alignment line 208 (not shown) to assure that her lead leg is straight, both directionally and rotationally. The front leg is bent, but the front knee does not overextend over the front foot. She then brings her left hand down to rest on her left leg, making contact at the above-knee indicium 202. It will be appreciated that a below-knee indicium or calf indicium may be used for deeper stretches within this pose. These steps may be taken as part of a sequence of poses, also called a vinyasa, and may progress from a High Lunge Pose, a Warrior I Pose, and/or a Warrior II Pose. After approximately thirty seconds to a minute, the practitioner reverses her movements and may repeat the exercise with opposite positioning. The alignment lines and indicia may be symmetrical for equal reference on both sides. Alternatively, as shown, the alignment lines and indicia are provided for reference on one side, and the body positioning may be copied over to the opposing side when the exercise is reversed. It will be appreciated that other configurations and arrangements are possible.

In reference to the foregoing figures, it will be appreciated that the depicted alignment lines and indicia may be used to assume other poses and positioning. For example, the ankle indicium 204 may be used as a contact guide to be grasped by a hand for yoga poses, such as the Extended Side Angle, Extended Triangle Pose, Bow Pose, Standing Half Forward Bend, and/or the like. Likewise, the above-knee indicium 202, mid-thigh indicium 206, and alignment lines may be used as contact guides or positional references for a number of other poses and positions. It will also be appreciated that the same alignment and indicia techniques may be employed on a shirt. For example, alignment lines may extend the length of the practitioner's arms on various sides, and contact indicia may be employed on various points of the arms, such as the shoulder, above the elbow, below the elbow, the forearm, and the wrist. Other configurations and arrangements are possible.

In reference to the foregoing figures, it will also be appreciated that specific coloring of the alignment lines and indicia may be used to trigger psychophysiological effects in the practitioner. Particular colors may be used to evoke emotions or feelings in the user as they exercise or participate in the various poses. For example, warm colors may be used for a stimulating effect and cool colors may be used for a calming effect. Specific colors may also be chosen to target specific emotions in the practitioner, such as those listed in the following examples. Red may be used to evoke romance, energy, excitement, or intensity. Orange may be used to evoke enthusiasm, change, happiness, and energy. Yellow may be used to evoke optimism, awareness, and cheer. Green may be used to evoke growth, tranquility, and harmony. Blue may be used to evoke serenity, wisdom, and focus. Brown may be used to evoke stability, security, and reliability. White may be used to evoke purity, cleanliness, and a neutrality. Black may be used to evoke authority, power, and strength. It will be appreciated that other configurations are possible.

Although the invention has been described in detail for the purpose of illustration based on what is currently considered to be the most practical and preferred and non-limiting embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

The invention claimed is:

1. Pants for use by a practitioner of a body position-dependent exercise or discipline to verify proper body positioning, comprising:

first and second pant legs;

at least three alignment lines extending substantially an entire length of the first pant leg, the at least three alignment lines configured to be referenced by the practitioner to confirm proper alignment of the practitioner's leg which corresponds to the first pant leg, according to at least one of direction, rotation, and pitch, wherein the at least three alignment lines comprise:

a first alignment line positioned vertically lengthwise on an anterior surface of the first pant leg of the pants, the first alignment line having an end at a waistband at a first point that is spaced from an anterior centered vertical axis of the anterior surface on a side of said axis opposite a front crotch seam, and the first alignment line continuing in a curvilinear path along the anterior surface to be aligned centrally with the anterior centered vertical axis at a lower opening of the first pant leg;

a second alignment line positioned vertically lengthwise on an inseam surface of the first pant leg, the second alignment line having an end at a crotch point of the pants and continuing along the first pant leg to terminate at the lower opening of the first pant leg;

a third alignment line positioned vertically lengthwise on a posterior surface of the first pant leg, the third alignment line having an end at said waistband at a second point that is spaced from a centered vertical axis of the posterior surface on a side of said axis opposite a rear crotch seam, and the third alignment line continuing in a curvilinear path along the posterior surface to be aligned centrally with the posterior centered vertical axis at the lower opening of the first pant leg; and at least three visual indicia each positioned on one of said first and second pant legs, the at least three visual indicia configured to be referenced, grasped, or touched by the practitioner during performance of the exercise or discipline, the at least three visual indicia comprising:

a first visual indicium on the second pant leg, positioned proximal to a knee portion of the second pant leg, the first visual indicium circumferentially wrapping around the second pant leg so as to be viewable from front, side, and rear perspectives;

a second visual indicium on the second pant leg, positioned proximal to an ankle portion of the second pant leg, the second visual indicium circumferentially wrapping around the second pant leg so as to be viewable from front, side, and rear perspectives; and a third visual indicium on the first pant leg, anteriorly positioned equidistant between the waistband and a knee portion of the first pant leg.

2. The pants of claim 1, wherein the pants comprise a stretchable material configured to be worn for yoga.

3. The pants of claim 1, wherein the at least three alignment lines comprise a first color, the at least three visual indicia comprises a second color, and the first color and the second color are a same color configured to trigger a predetermined psychophysiological reaction in the practitioner.

4. The pants of claim 3, wherein a visual indicium of the at least three visual indicia comprises a chakra symbol for reference by the practitioner that is configured to represent a state of mind corresponding to a target state of mind to be acquired by executing a series of poses represented by positioning of the at least three visual indicia.

* * * * *